US006098299A

United States Patent [19]

Collins et al.

[11] Patent Number: 6,098,299

[45] Date of Patent: Aug. 8, 2000

[54] CHALK LINE HOLDER

[75] Inventors: James E. Collins; Daniel Collins, both of St. Charles; Gary Nosek, Yorkville, all of Ill.

[73] Assignee: Keson Industries, Inc., Naperville, Ill.

[21] Appl. No.: 09/070,293

[22] Filed: Apr. 30, 1998

[51] Int. Cl.[7] ..... B44D 3/38

[52] U.S. Cl. ..... 33/414; 24/122.3

[58] Field of Search ..... 33/761, 414, 756, 33/755, 757, 769, 413, 767, 770, 768; 24/122.3, 115 F, 115 H

[56] References Cited

U.S. PATENT DOCUMENTS

| | | | |
|---|---|---|---|
| 304,716 | 9/1884 | Findlay . | |
| 467,849 | 1/1892 | Bean . | |
| 797,589 | 8/1905 | Levin . | |
| 948,026 | 2/1910 | Scotchmer . | |
| 1,208,068 | 12/1916 | Winchell . | |
| 2,485,385 | 10/1949 | Komassa . | |
| 2,521,178 | 9/1950 | Meletti . | |
| 2,546,202 | 3/1951 | Trouin . | |
| 2,559,111 | 7/1951 | Carroll . | |
| 2,584,559 | 2/1952 | Dalrymple . | |
| 2,587,652 | 3/1952 | Rostine . | |
| 2,609,160 | 9/1952 | Van Sciver et al. . | |
| 2,959,371 | 11/1960 | Melton . | |
| 2,990,131 | 6/1961 | Carlsson . | |
| 3,114,515 | 12/1963 | Kane . | |
| 3,188,052 | 6/1965 | Longworth . | |
| 3,289,969 | 12/1966 | Purbaugh . | |
| 3,482,798 | 12/1969 | Kawaguchi . | |
| 3,587,474 | 6/1971 | Fuchs . | |
| 3,689,004 | 9/1972 | Brown et al. . | |
| 3,716,201 | 2/1973 | West . | |
| 3,879,016 | 4/1975 | Kankkunen . | |
| 3,889,897 | 6/1975 | Van Zelderen . | |
| 4,067,513 | 1/1978 | Rutty et al. . | |
| 4,192,078 | 3/1980 | Lore et al. . | |
| 4,270,708 | 6/1981 | Vonk . | |
| 4,272,036 | 6/1981 | Watermann . | |
| 4,434,952 | 3/1984 | Czerwinski et al. . | |
| 4,456,195 | 6/1984 | Takada . | |
| 4,500,048 | 2/1985 | Schaller . | |
| 4,565,011 | 1/1986 | Karger . | |
| 4,592,148 | 6/1986 | Longenette . | |
| 4,765,557 | 8/1988 | Kahmann | 33/756 |
| 4,813,145 | 3/1989 | Josey, Jr. et al. . | |
| 5,042,159 | 8/1991 | Millen | 33/414 |
| 5,421,100 | 6/1995 | Leore | 33/758 |
| 5,423,494 | 6/1995 | Kondo . | |
| 5,509,616 | 4/1996 | Millen, Jr. et al. | 33/414 |
| 5,531,395 | 7/1996 | Hsu . | |
| 5,822,874 | 10/1998 | Nemes | 33/414 |
| 5,906,233 | 5/1999 | May | 24/115 F |
| 5,920,997 | 7/1999 | Girtman | 33/414 |

FOREIGN PATENT DOCUMENTS

| | | | |
|---|---|---|---|
| 699448 | 12/1964 | Canada | 24/115 H |
| 243675 | 11/1965 | Germany | 24/115 H |

*Primary Examiner*—Diego Gutierrez
*Assistant Examiner*—Faye Francis
*Attorney, Agent, or Firm*—Wood, Phillips, VanSanten, Clark & Mortimer

[57] ABSTRACT

According to an aspect of the present invention, a chalk line holder has a housing, an operating mechanism on the housing, with a spool around which a supply of line can be wound and moveable relative to the housing about a first axis, and a brake assembly for the spool. The brake assembly has a ratchet element moveable with the spool about the first axis, a pawl moveable transversely to the first axis between a) an engaged position wherein the pawl engages the ratchet element to prevent movement of the spool in a first direction about the first axis and b) a disengaged position, a biasing element normally urging the pawl towards the engaged position, and an actuator to move the pawl towards the disengaged position against the urging of the biasing element.

19 Claims, 3 Drawing Sheets

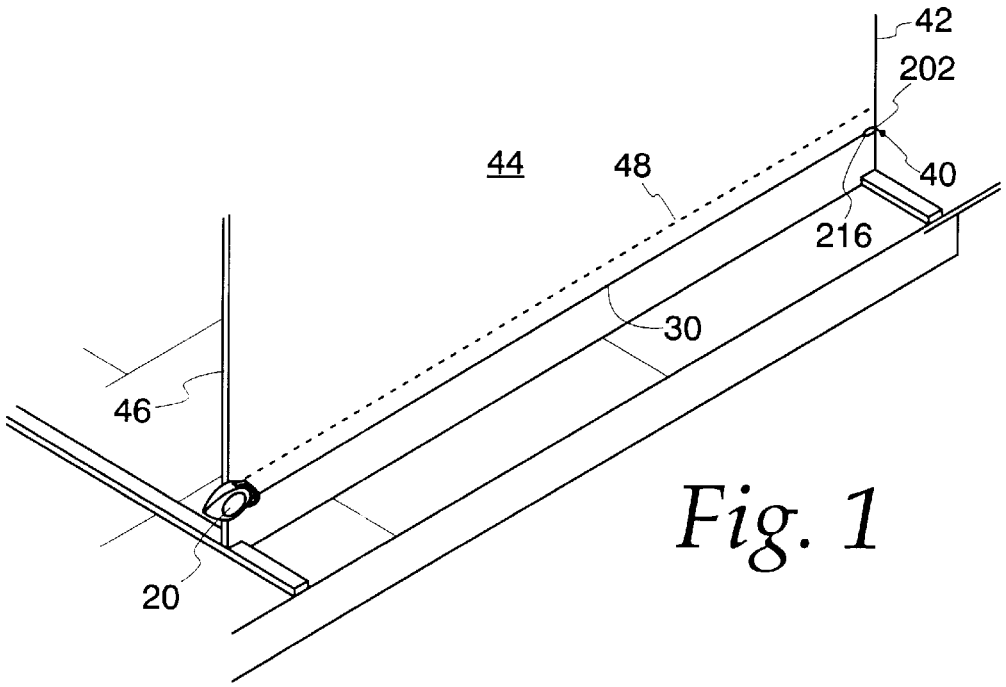
Fig. 1
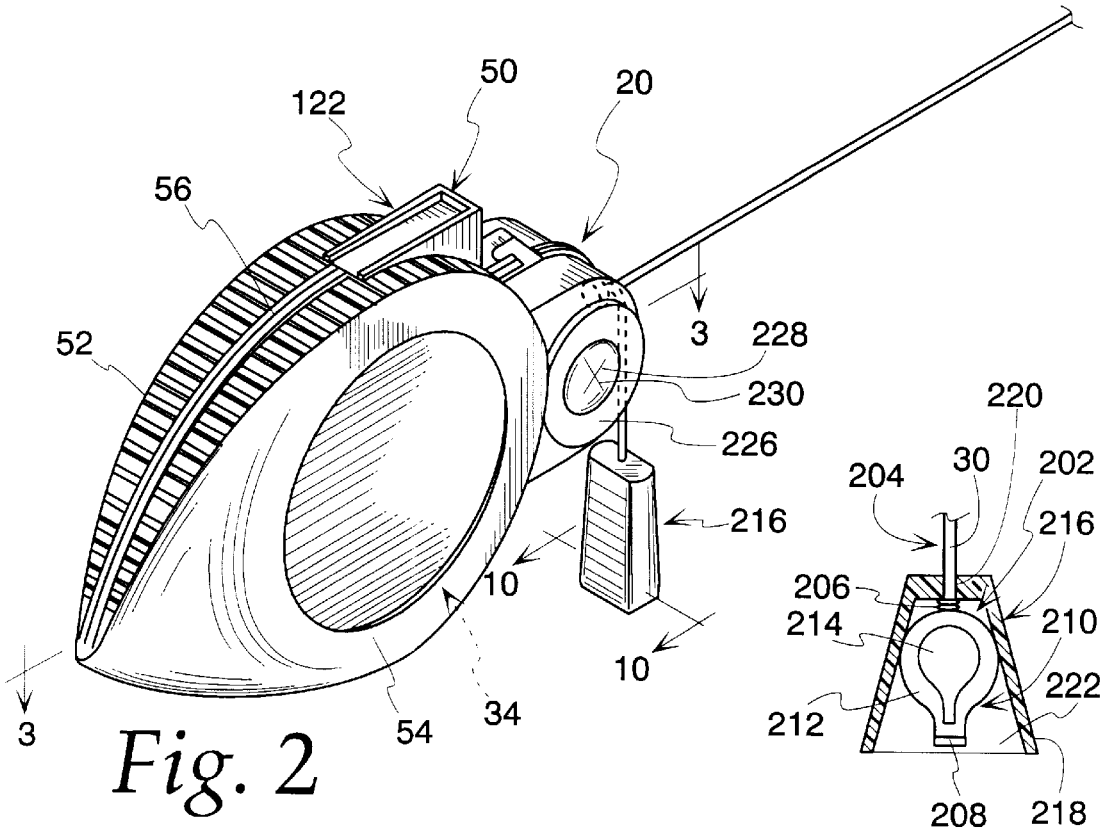
Fig. 2
Fig. 10

CHALK LINE HOLDER

FIELD OF THE INVENTION

This invention relates to a chalk line holder, and, in particular, to a chalk line holder which allows for controlled automatic retrieval of the chalk line from a paid-out state.

BACKGROUND OF THE INVENTION

A chalk line is a string which has been impregnated with chalk dust. Chalk lines are frequently used on construction sites to mark colored lines on ceilings, floors, and walls. Quite often, the colored lines to be marked are of considerable length, consequently requiring a chalk line of considerable length. It is therefore known in the art to store the chalk line in a chalk line holder wound about a spool.

To use the holder, one end of the chalk line is secured to a post by means of a hook, for example, attached to one end of the chalk line. The chalk line holder is then moved away from the secured end of the chalk line to pay the chalk line off of the spool. When a predetermined length of chalk line has been paid off of the spool, the chalk line is held taut and snapped to produce a colored line on the ceiling, floor, or wall.

Once the colored line has been marked on the desired surface, it is necessary to wind the chalk line back onto the spool. U.S. Pat. No. 4,272,036 features a manually-operated crank which moves the spool through an associated gear train. Movement of the crank handle about its axis causes movement of the spool about its axis, causing the chalk line to be wound onto the spool.

There are several disadvantages to using a manually-operated crank system, such as shown in U.S. Pat. No. 4,272,036. Chief among the disadvantages is the effort which the operator must exert in order to get the chalk line wound onto the spool.

To overcome the disadvantages of a manually-operated line-retrieval system, it is known in the art to use an automatic line-retrieval system, such as is shown in U.S. Pat. No. 4,765,557. In U.S. Pat. No. 4,765,557, a spring is used to bias the spool toward a fully wound position, thereby achieving automatic retrieval of the chalk line.

The system of U.S. Pat. No. 4,765,557, however, also has disadvantages. For instance, the speed at which the line is wound onto the spool is not directly controlled by the user, as is the case with the manually-operated system. Instead, the size and strength of the spring directly controls the speed at which the line is wound onto the spool. Additionally, chalk dust must be prevented from entering the automatic retrieval system, and thereby degrading the performance of the automatic retrieval system.

It is known in the art to provide a brake or lock system which the operator can use to indirectly control the speed at which the line is wound onto the spool. For example, U.S. Pat. Nos. 4,565,011; 4,592,148; 4,765,557; and 4,813,145 all provide frictional braking systems wherein a brake surface is pressed against a portion of the spool to limit the speed at which the spool rotates or fix the position of the spool relative to a housing. U.S. Pat. Nos. 4,192,078 and 5,509,616 disclose ratchet/pawl braking systems which can be used to control the rate of retrieval of the line onto the spool. U.S. Pat. No. 5,509,616 also features a centrifugal speed regulator with brake elements bearing against a central arbor to limit the speed or rate of retrieval of the line onto the spool.

With respect to the problem of chalk dust contaminating the automatic retrieval system, it is known in the art to make a chalk line holder having a partition which divides the holder housing into two compartments. A first compartment houses the spool, the chalk line, and the chalk dust for impregnating the chalk line. The second compartment houses a torsion spring which cooperates with the spool to cause the spool to rotate to thereby automatically retrieve the chalk line when tension on the chalk line is released or the braking mechanism is moved to a disengaged position. See, for example, U.S. Pat. Nos. 4,192,708; 4,592,148; and 5,042,159.

It is also known in the art to make a hollow spool which is used to house the torsion spring, with an opening formed in the hollow spool to accept a post which is fixed to the housing. The torsion spring is then attached at one end to the fixed post and at the other end to the inside of the hollow spool. See, for example, U.S. Pat. No. 4,765,557. In addition, it is also known in the art to provide a post which is releasably fixable to the housing, and is associated with the hollow spool. See, for example, U.S. Pat. Nos. 4,813,145 and 5,509,616.

SUMMARY OF THE INVENTION

According to an aspect of the present invention, a chalk line holder has a housing, an operating mechanism on the housing, with a spool around which a supply of line can be wound and moveable relative to the housing about a first axis, and a brake assembly for the spool. The brake assembly has a ratchet element moveable with the spool about the first axis, a pawl moveable transversely to the first axis between a) an engaged position wherein the pawl engages the ratchet element to prevent movement of the spool in a first direction about the first axis and b) a disengaged position, a biasing element normally urging the pawl towards the engaged position, and an actuator to move the pawl towards the disengaged position against the urging of the biasing element.

The biasing element may include a spring acting between the housing and the actuator, and the actuator may be moveable about a second axis between the engaged and disengaged position. In such a case, a flange may be formed integrally with the spool, the flange having a notch defining the ratchet element, and a brake surface may be formed integrally with the actuator, the brake surface defining the pawl.

The operating mechanism may also include a centrifugal brake assembly. The centrifugal brake assembly may have a brake surface on the housing facing inward with respect to the first axis, and a brake element moveable with the spool relative to the housing and moveable radially outwardly relative to the first axis relative to the spool. The brake element may be moveable relative to the spool as an incident of the movement of the spool about the spool axis between a) a first position wherein the brake element is urged against the brake surface to generate a first braking force as an incident of the spool rotating at a first predetermined velocity and b) a second position wherein the brake element is not urged against the brake surface to generate a braking force as large as the first braking force.

Furthermore, the centrifugal brake assembly may further have a cylindrical rim on the housing having a radially inward facing surface with respect to the first axis defining the brake surface, the brake element disposed between the rim and the spool axis.

Moreover, the centrifugal brake assembly may include two brake elements. Each of the brake elements may have a first end pivotably mounted on the spool and a second end which is moveable radially outward with respect to the first axis relative to the spool and defines an arcuate brake surface which is urged against the brake surface with the brake element in the first position to generate the first braking force as an incident of the spool rotating at a first predetermined velocity.

The spool may have a) a line-carrying frame moveable relative to the housing from a first, line-retrieve position wherein a line carried on the frame is fully wound about the spool and a paid-out position and b) a line-retrieval assembly on the line-carrying frame. The line-retrieval assembly may include a post fixed relative to the housing and a biasing element having first and second ends, the first end attached to the frame and the second end attached to the post so as to urge the frame towards the line-retrieve position. The frame may have a frame wall which defines an enclosed space, and the line-retrieval assembly may be disposed within the enclosed space to prevent chalk dust disposed in the housing from collecting on the biasing element.

A first connector may be disposed on the housing wall and a second connector may be disposed on the post, the second connector capable of coupling with the first connector to prevent the rotational movement of the post relative to the housing. In such case, the frame wall may have an opening through which the first and second connectors are coupled. Either the first or second connector may be a post of non-circular cross-section and the other of the first or second connector may be a recess of non-circular cross-section.

Additionally, an L-shaped post may be disposed on the housing about which the chalk line is disposable to prevent movement of the spool toward the first, line-retrieve position.

The chalk line holder may be combined with a chalk line having first and second ends, the chalk line attached at the first end to the spool, and a hook assembly attached to the second end of the chalk line, the hook assembly consisting of a hook and a sheath which is disposable over the hook. The sheath may have a wall which defines a receptacle and which has an opening therethrough to accept the second end of the chalk line with the second end of the chalk line attached to the hook. The sheath may be moveable along the chalk line between a covered position wherein the sheath is disposed along the chalk line such that the hook is disposed within the receptacle and an uncovered position.

The housing wall may be made up of two housing wall pieces which define a receptacle therebetween. The housing wall may also have an opening therethrough. An elastomeric plug may be disposed in the opening to prevent chalk dust disposed within the space from leaking out of the housing. The plug may have a resealable slit therethrough to allow chalk dust to be introduced into the space when the slit is opened.

According to another aspect of the invention, a chalk line holder has a housing, an operating mechanism on the housing, with a spool around which a supply of line can be wound, and a brake assembly. The spool has a) a central hub with a cylindrical surface and a central axis and b) two flanges spaced axially relative to the central axis so that the flanges and cylindrical surface cooperatively define a space for a supply of chalk line. The brake assembly includes a notch in each of the two flanges, a brake surface capable of being seated in the notches, an actuator formed integrally with the brake surface and pivotably mounted on the housing for movement between a) an engaged position wherein the brake surface is seated in the notches to prevent movement of the spool in a first rotational direction about the central axis and b) a disengaged position, and a spring for urging the actuator towards the engaged position.

In such a case, the actuator may be a T-shaped switch having a crossbar and a post, the brake surface defined by a surface of the crossbar of the T-shaped switch. Moreover, the T-shaped switch may be mounted on the housing about an axis parallel to and offset from the spool axis such that the post of the T-shaped switch is parallel to a tangent to the cylindrical surface with the actuator in the engaged position.

BRIEF DESCRIPTION OF THE DRAWINGS

FIG. 1 is a perspective drawing showing a chalk line holder according to the present invention as it would be used on a construction site;

FIG. 2 is an enlarged, perspective view of the chalk line holder with the chalk line in a fully retrieved position in solid line, and in a fully paid-out position in phantom line;

FIG. 10 is an enlarged, cross-sectional view of a catch hook assembly attached to the chalk line.

DETAILED DESCRIPTION OF THE PREFERRED EMBODIMENT

Figure 3:
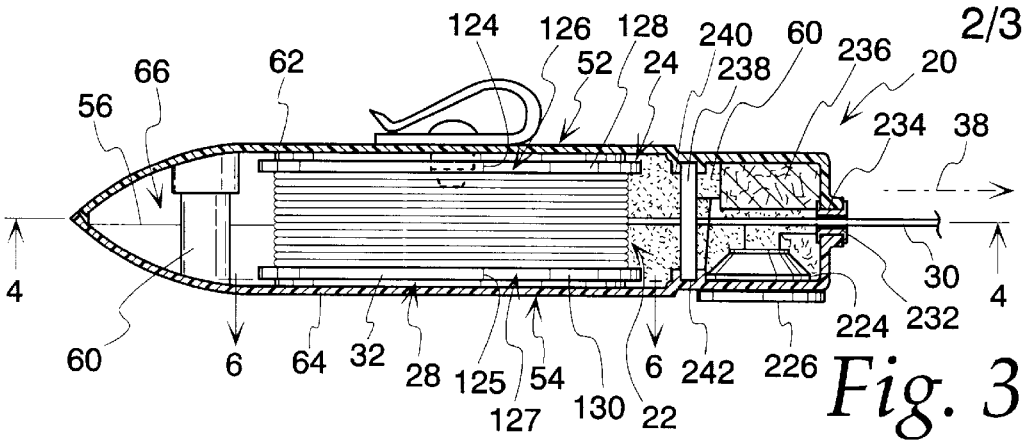
FIG. 3 is an enlarged, cross-sectional view taken along line 3—3 in FIG. 2 showing the chalk line holder housing and a line-carrying spool mounted on the housing.
Figure 4:
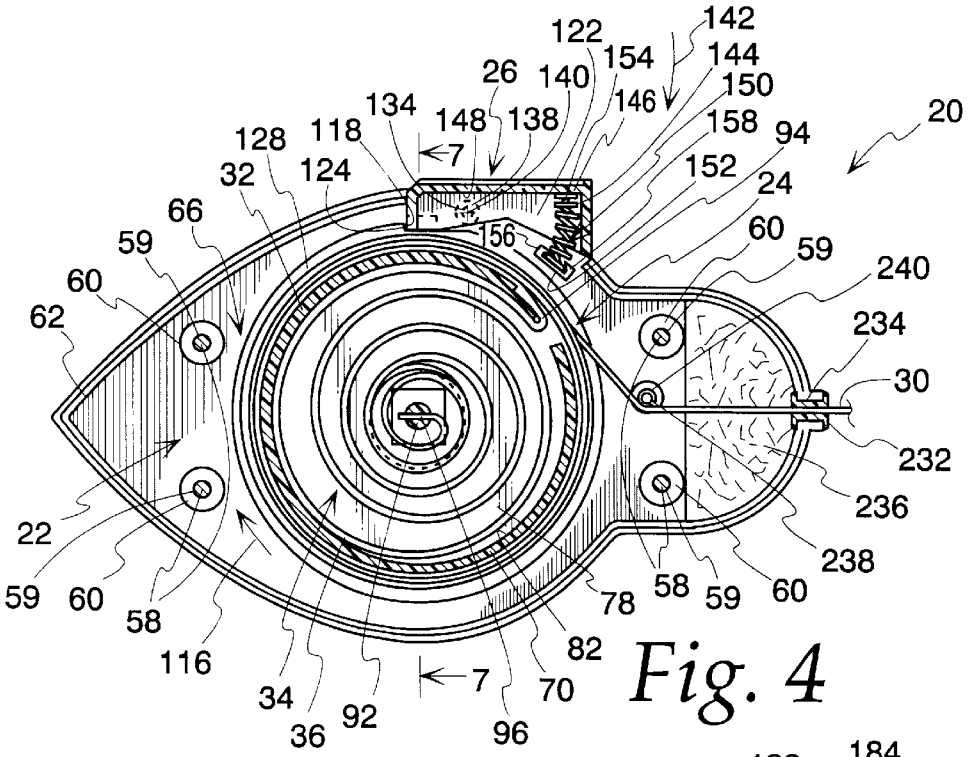
FIG. 4 is an enlarged, cross-sectional taken along line 4—4 in FIG. 3 showing in detail the line-carrying spool, a line-retrieval assembly, and a brake assembly, with the brake assembly in an engaged position.
Figure 6:
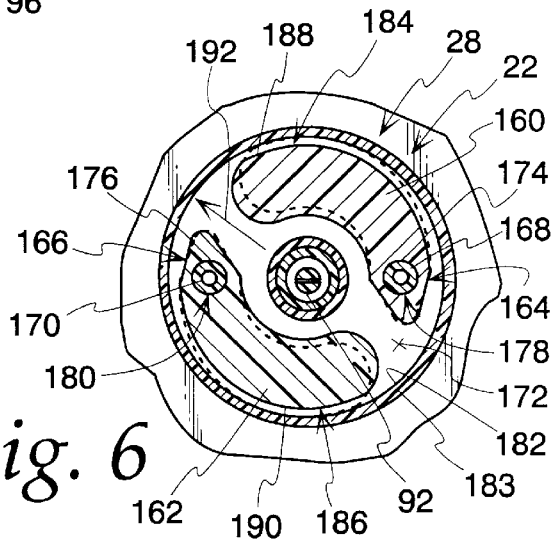
FIG. 6 is an enlarged, cross-sectional view taken along line 6—6 in FIG. 3 showing in detail a centrifugal brake assembly having brake elements movable with the spool about the spool axis.

A chalk line holder 20 according to the present invention is discussed first with reference to FIGS. 3, 4 and 6. The chalk line holder 20 has an operating mechanism 22 which includes a rotatable spool 24, a rachet/pawl brake assembly 26, and a centrifugal brake assembly 28. A line 30 is attached to the spool 24, about which the line 30 may be wound.

In particular, the spool 24 has a line-carrying frame 32 about which the line 30 is wound. The line-carrying frame 32 is rotatably moveable between a first, line-retrieve position with the line 30 fully wound about the frame 32, and a second, paid-out position with the line 30 fully paid off of the frame 32. The spool 24 also has a line-retrieval assembly 34, including a biasing element 36, which urges the line-carrying frame 32 towards the line-retrieve position.

In operation, a force is exerted on the line 30 in the direction of the arrow 38 in FIG. 3. Such application of force causes the line 30 to be paid out from the holder 20. As seen in FIG. 1, the line 30 may then be attached to a nail 40, or the like, secured to a first edge 42 of a wall 44, and the holder 20 moved away from the edge 42 towards a second edge 46, as shown in FIG. 1, to cause the line 30 to span a distance to be marked. Once the holder 20 is moved to the edge 46, the line 30, which is impregnated with chalk dust and under tension, is snapped, thereby leaving a chalk dust line 48 on the wall 44.

Once the chalk dust line 48 has been made by snapping the line 30 such that it contacts the wall 44, the line 30 can be wound back onto the spool 24. To prevent the inadvertent retraction of the line 30 into the holder 20, the rachet/pawl brake assembly 26 releasably maintains the spool 24 in a fixed position. To prevent retraction of the line 30 at excessive speeds, the centrifugal brake assembly 28 operates to control the rotational speed of the spool 24 as induced by the biasing element 36. The rachet/pawl brake assembly 26 may also be used in conjunction with the centrifugal brake assembly 28, as required, to control the rotational speed of the spool 24 as the line 30 is wound onto the spool 24.

Figure 5:
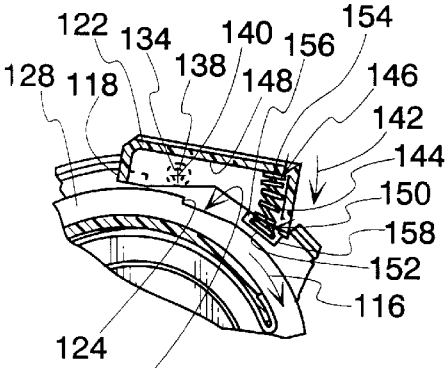
FIG. 5 is a fragmentary, cross-sectional view showing the brake assembly in a disengaged position, the spool being free to move about its axis between a first, line-retrieve position and a second, paid-out position.

The holder 20 is now discussed in greater detail with reference first to FIGS. 2–4. The holder 20 has a housing 50 with a left half 52 and a right half 54. The two halves 52, 54 meet along a parting plane 56, about which the holder 20 is generally symmetrical. As a consequence, while only the left half 52 of the housing 50 is shown in FIGS. 4 and 5, the discussion provided herein is generally applicable to the right half 54 as well.

The two halves 52, 54 are joined together by fasteners 58. The fasteners 58 are secured in threaded bores 59 in mounting posts 60 which project from the wall 64 of the right half 54 of the housing 50 toward the wall 62 of the left half 52 of the housing 50. With the two halves 52, 54 joined together, the walls 62, 64 define an interior space 66 in which the operating mechanism 22 is contained.

Figure 7:
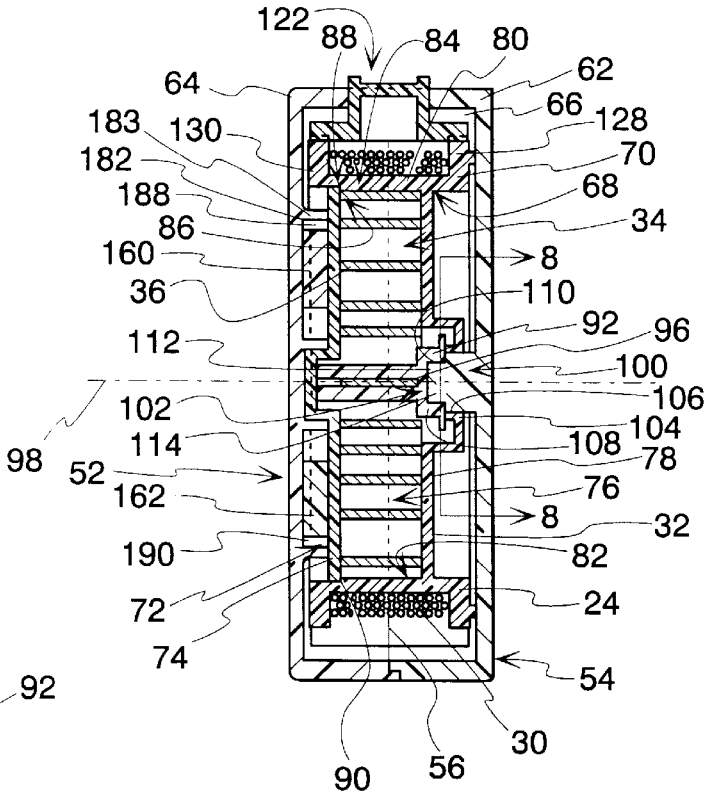
FIG. 7 is a cross-sectional view taken along line 7—7 in FIG. 4 showing the spool, the line-retrieval assembly, the centrifugal brake assembly and the brake assembly.

Similarly, with reference additionally to FIG. 7, the frame 32 of the spool 24 includes a first cup-like frame element 68 with a wall 70 and a second, plate-like frame element 72 with a wall 74, which when joined together, as through an adhesive, define an interior, enclosed space 76 between the walls 70, 74. Specifically, the wall 70 of the cup-like frame element 68 has a substantially planar base 78 and a substantially cylindrical collar 80 secured at a first edge 82 to the base 78. The cylindrical collar 80 has a stepped region 84 located at a second edge 86. The stepped region 84 defines a shoulder 88 against which a rim 90 of the plate-like element 72 abuts with the plate-like element 72 seated in the stepped region 84 of the cup-like element 68.

Disposed within the interior space 76 of the spool frame 32 is the line-retrieval assembly 34. In particular, the line-retrieval assembly 34 includes the biasing element 36 and a post 92. The biasing element 36, which is a spiral spring as shown, has a first effective end 94, which is attached to the cylindrical collar 80, and a second effective end 96, which is attached to the post 92.

Figure 8:
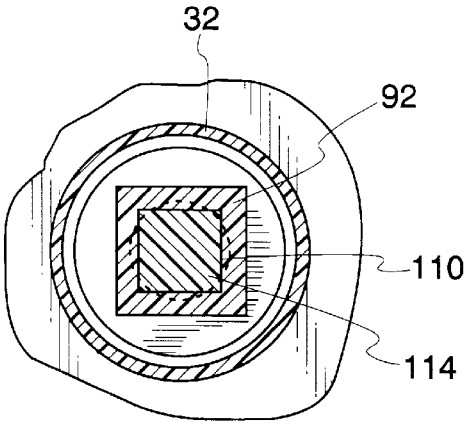
FIG. 8 is a fragmentary, cross-sectional view taken along line 8—8 in FIG. 7 showing first and second connectors used to hold a post of the line-retrieval assembly fixed relative to the housing.

While the spool 24 is free to rotate relative to the housing 50 about an axis 98, the post 92 is prevented from moving about the axis 98 by a locking mechanism 100. Specifically, the post 92 has a first end 102 which abuts a rim 104 about an opening 106 in the frame 34. The first end 102 has a stepped region 108, with a shoulder 110 which defines a recess 112. The recess 112 has a non-circular cross-section, preferably a square cross-section. A post 114 secured to the housing 50, or more preferably formed as one-piece with the housing 50, has a non-circular cross-section which is complementary to the cross-section of the recess 112. By disposing the post 114 in the recess 112 (FIG. 8) with the spool 24 mounted between the left and right halves 52, 54 of the housing 50, movement of the post 92 about the axis 98 is substantially prevented.

Movement of the line 30 in the direction of the arrow 38 causes the frame 32 of the spool 24 to move in a clockwise direction (arrow 116) as viewed in FIG. 4. With the housing 50 held fixed, the post 92 is prevented from moving about the axis 98 with the frame 32 of the spool 24. As a consequence, the torsion spring 36 is moved from a relaxed state to a loaded state, wherein the spring exerts a force opposite to the force being exerted on the line 30 to pull it from the holder 20. The greater the amount of line 30 that is withdrawn from the holder 20, the more tightly wound the spring 36 becomes.

If no braking mechanisms were provided, the line-retrieval assembly 34 would operate to move the spool 24 from the paid-out state to the line-retrieve state as soon as the line 30 was released by the user or detached from a fastener, such as the nail 40. However, the rachet/pawl braking mechanism 26 is provided to prevent movement of the spool 24 about the axis 98 upon the release of the line 30. The rachet/pawl braking mechanism 26 cooperates with the spool 24 to hold the spool 24 substantially fixed relative to movement about the axis 98.

Figure 11:
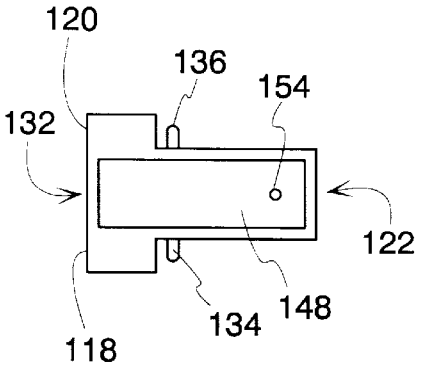
FIG. 11 is a bottom view of an actuator used in the brake assembly.

As seen in FIG. 11, the rachet/pawl braking mechanism 26 includes braking surfaces 118, 120 defined on an actuator 122 and braking surfaces 124, 125 defined by notches 126, 127 on flanges 128, 130 of the frame 32, and in particular the cup-like frame element 68. As seen in FIGS. 4 and 5, the actuator 122 is pivotably mounted on the housing 50 for movement transverse to the axis 98 between an engaged position (FIG. 4) and a disengaged position (FIG. 5). In the engaged position, the braking surfaces 118, 120 of the actuator 122 abuttingly engage the braking surfaces 124, 125 of the frame 34 to prevent movement of the spool 24 about the axis 98. In the disengaged position, the braking surfaces 118, 120 are spaced from the braking surfaces 124, 125, thereby allowing the spool 24 to move.

The actuator 122 is in the form of a T-shaped element (FIGS. 7 and 11), with the braking surfaces 118, 120 being defined along a rearwardmost edge 132. The actuator 122 also has lugs 134, 136 which are disposed within recesses (one of which, numbered 138, is shown in FIGS. 4 and 5) such that the actuator 122 is pivotable about an axis 140 between the engaged and disengaged positions in the direction of an arrow 142. The actuator 122 is urged towards the engaged position, with the braking surfaces 118, 120, 124, 125 abutting, by a spring 144 with a first end 146 abutting an undersurface 148 of the actuator 122 and a second end 150 abutting a stop 152 formed on the housing 50. The undersurface 148 has a post 154 secured thereon which is passed through the coils of the spring 144 to prevent motion of the first end 146 of the spring 144 along the undersurface 148, while the stop 152 has rims 156, 158 formed therewith to prevent the movement of the second end 150 of the spring 144 relative to the stop 152.

In addition to the rachet/pawl brake assembly 26, the centrifugal brake assembly 28 is provided to control the speed at which the line 30 is retrieved onto the spool 24 (FIGS. 6 and 7). The centrifugal brake assembly 28 includes two arcuately shaped brake shoes 160, 162. Each of the brake shoes 160, 162 has a first end 164, 166 which is pivotably mounted to posts 168, 170 formed preferably integrally with a first side 172 of the plate-like frame element 72. Specifically, the brake shoes 160, 162 have holes 174, 176 formed in the first ends 166, 168 thereof, an end 178, 180 of the posts 168, 170 passed therethrough to define a pivotable connection.

The centrifugal brake assembly 28 also includes a brake surface 182 defined by a cylindrical rim 183 attached to the wall 64 of the right half of the housing 50. The brake surface 182 is cylindrical in shape, radially inwardly facing with respect to the axis of rotation 98 of the spool 24. The brake shoes 160, 162 also have arcuate second ends 184, 186 which are moveable radially outwardly with respect to the axis 98, and which define brake surfaces 188, 190 that are urged through centrifugal forces against the brake surface 182 in the direction of the arrow 192 (from the solid lined position to that shown in phantom line) to generate a first braking force as an incident of the spool 24 rotating at a first predetermined velocity. As a further consequence, the higher the speed of the spool 24, the greater the frictional stopping force generated by the brake surfaces 188, 190 abutting against the brake surface 182.

As mentioned above, the rachet/pawl brake assembly 26 and the centrifugal brake assembly 28 can be operated in combination to control the speed of the retrieval of the line 30 onto the spool 24. In particular, if the force generated by the brake assembly 28 is insufficient to reduce the speed of the spool 24 during retrieval, the brake assembly 26 can be actuated to "feather" the spool or to abruptly fix the angular position of the spool 24. As a consequence, the rapid deceleration of the spool 24 will have a concomitant effect on the speed of the retrieval of the line 30 onto the spool 24.

To maintain the line tautly in the paid out the position, the housing 50 further has a fastening post 194 (FIG. 9), which is preferably formed as one piece with the left housing half 52 or the right housing half 54. The fastening post 194 is L-shaped, with an upper member 196 and a lower member 198. The line 30 is wrapped in a loop 200 about the lower member 198 to prevent the line 30 from retracting and to snugly hold the line 30 taut without the user or the operating mechanism 22 holding the line 30 taut. The upper member 196 ensures that the line 30 does not slip off of the lower member 198.

To maintain the line 30 securely to the nail 40, for example, the line 30 has a metal hook 202 attached to an end 204 thereof with a knot 206 (FIG. 10). The metal hook 202 is L-shaped, with a protruding lip 208 extending from the page and a base 210 lying in the page in FIG. 10. The base 210 has a frame 212 which defines a hole 214 through which the nail 40, for example, may be passed. Alternatively, the lip 208 may be placed into abutment with the edge 42 of the wall 44.

To cover the hook 202, thereby preventing accidental contact therewith during retraction of the line 30, a sheath 216 is provided. The sheath 216 has a hollow, cup-like wall 218 with a hole 220 through which the end 206 of the line 30 is disposed to be secured to the hook 202. The wall 218 defines a receptacle 222 in which the hook 202 may be maintained when not attached to the nail 40 or the edge 42, 46 of the wall 44, for example. As a result, inadvertent contact with the hook 202 may be limited.

Figure 9:
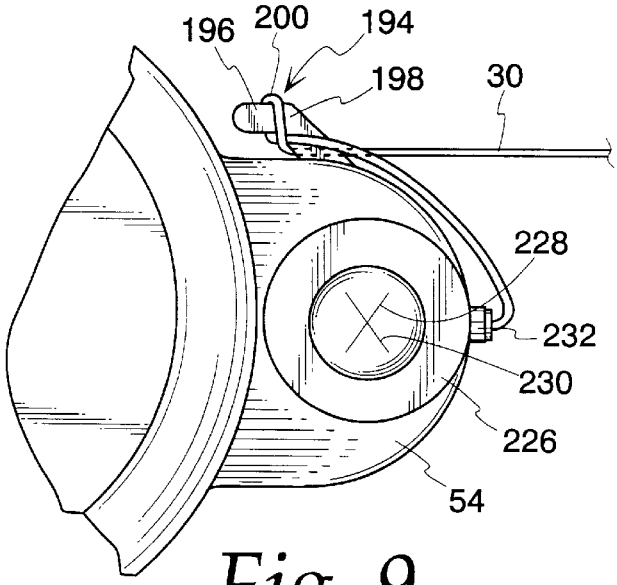
FIG. 9 is a fragmentary, side view showing the chalk line disposed about a chalk line retaining post on the housing.

In addition to the foregoing, the holder 20 also has a mechanism for allowing the holder 20 to be refilled with chalk dust without separating the left and right halves 52, 54 of the housing 50 and while preventing the seepage of chalk dust from the holder 20. Specifically, an aperture 224 (FIG. 3) is provided in the wall 64 of the right housing half 54 through which a stopper or plug 226 is disposed. The stopper 226 is made of an elastomeric material with two slits 228, 230 therethrough (FIGS. 2 and 9). The slits 228, 230 are crossed, and when parted, provide resealable access to the interior space 66. This structure may be combined with a metal guide structure 232 which provides a tighter fit at a hole 234 through which the line 30 exits the housing 50. A felt cushion 236 may also be used to wipe the excess chalk dust from the line 30 before the line 30 is passed through the guide structure 232.

Additionally, the holder 20 has a mechanism for aligning the line 30 with the spool 24. As seen in FIGS. 3 and 4, a rod 238 is disposed in recesses 240, 242 defined in the walls 62, 64 of the housing halves 52, 54 to maintain the line 30 in a direct line with the hole 234 in the housing 50 through which the line 30 passes. In this fashion, excess stresses in the line 30 and the housing 50 in the region proximate to the hole 234 may be avoided.

As discussed above, in operation, a force is exerted on the line 30 in the direction of the arrow 38 in FIG. 2. Such application of force causes the line 30 to be paid out from the holder 20. The sheath 216 may then be moved along the line 30 to expose the hook 202. The hook 202 may then be attached to the nail 40 or the first edge 42 of the wall 44 either by passing the nail 40 through the hole 214 of the hook 202 or by abutting the lip 208 of the hook 202 against the edge 42.

With the end 204 of the line 30 securely fastened, the holder 20 may be moved in the direction away from the edge 42 of the wall 44, or the line 30 may be pulled from the holder 20. To allow the spool 24 to freely move about its axis 98, the actuator 122 is depressed, as shown in FIG. 5 in the direction of the arrow 142. With the actuator 122 depressed, the brake surfaces 118, 120 of the actuator 122 are moved out of abutting engagement with the brake surfaces 124, 125 of the spool 24. The speed at which the line 30 is paid out of the holder 20 is still controlled by the centrifugal brake assembly 28, whereby the motion of the spool 24 above a predetermined angular velocity about its axis 98 will cause the brake surfaces 188, 190 to abut the brake surface 182, thereby generating a frictional stopping force which will resist the movement of the spool 24.

With the desired amount of line 30 paid out of the spool, for example when the second edge 46 of the wall 44 is reached, the actuator 122 is released, and the spring 144 urges the brake surfaces 118, 120 of the actuator 122 into engagement with the brake surfaces 124, 125 of the spool 24, the rearwardmost edge 132 lying in the notches 126, 127 of the left and right flanges 128, 129 of the spool 24. As a consequence, the angular position of the spool 24 is fixed relative housing 50, and the spool resist the urging of the spring 36 of the line-retrieval assembly 34 to retrieve the line 30.

At this point, the loop 200 of the line 30 may be formed about the lower member 198 of the post 194, helping the line 30 to be held fixed and taut. The line 30, which is impregnated with chalk dust, may then be snapped, thereby leaving the chalk dust line 48 on the wall 44.

Once the chalk dust line 48 has been made by snapping the line 30 such that it contacts the wall 44, the line 30 can be wound onto the spool 24. To do this, the line 30 is unlooped from the post 194. The actuator 122 is then depressed in the direction of the line 142, so that the braking surfaces 118, 120, 124, 125 are no longer abutting. As a consequence, the spool 24 can move at the urging of the line-retrieval assembly 34 from a paid-out position to a filly wound position. Particularly, the spring 36, which is attached at one end 94 to the spool 24 and the other end 96 to the post 92, urges the spool 24 toward the filly wound position.

At this point, the end 204 of the line 30 may also be detached from the nail 40 or the edge 42 of the wall 44. The line 30 is then wound onto the spool 24 at the urging of the spring 36, with the centrifugal brake assembly 28 actuating in accordance with the speed of the spool 24 to prevent excessively fast retrieval of the line 30. The rachet/pawl brake assembly 26 may also be actuated, i.e. the actuator 122 allowed to return to the rest state with the braking surfaces 118, 120, 124, 125 abutting, to limit the speed of the spool 24 and the retrieval of the line 30.

Preferably, to prevent injury, the sheath 216 is placed over the hook 202 before the brake assembly 26 is put into the disengaged position. This provides a further protection when the line 30 is retrieved onto the spool 24.

Still other aspects, objects, and advantages of the present invention can be obtained from a study of the specification, the drawings, and the appended claims.

What is claimed is:

1. A chalk line holder comprising:

a housing; and an operating mechanism on the housing comprising a spool around which a supply of line can be wound and moveable relative to the housing about a first axis and a brake assembly for the spool, the spool comprising a) a central hub with a central axis and b) two flanges spaced axially relative to the central axis so that the flanges and central hub cooperatively define a space for a supply of chalk line, the brake assembly comprising, a notch on each of the two flanges, at least one brake surface, at least one pawl moveable transversely to the first axis between a) an engaged position wherein the at least one pawl engages both of the notches to prevent movement of the spool in a first direction about the first axis and b) a disengaged position, a biasing element normally urging the at least one pawl towards the engaged position, and an actuator to move the pawl towards the disengaged position against the urging of the biasing element.

2. The chalk line holder according to claim 1, wherein:

the biasing element comprises a spring acting between the housing and the actuator; and the actuator is moveable about a second axis between the engaged and disengaged position, wherein the second axis is substantially parallel to the first axis.

3. The chalk line holder according to claim 2, wherein a brake surface is formed integrally with the actuator, the brake surface defining the pawl.

4. The chalk line holder according to claim 1, wherein the operating mechanism further comprises a centrifugal brake assembly, the centrifugal brake assembly comprising:

a brake surface on the housing facing inward with respect to the first axis; and a brake element moveable with the spool relative to the housing and moveable radially outwardly relative to the first axis relative to the spool, the brake element moveable relative to the spool as an incident of the movement of the spool about the spool axis between a) a first position wherein the brake element is urged against the brake surface to generate a first braking force as an incident of the spool rotating at a first predetermined velocity and b) a second position wherein the brake element is not urged against the brake surface to generate a braking force as large as the first braking force.

5. The chalk line holder according to claim 4, wherein the centrifugal brake assembly further comprises a cylindrical rim on the housing having a radially inward facing surface with respect to the first axis defining the brake surface, the brake element disposed between the rim and the spool axis.

6. The chalk line holder according to claim 5, further comprising two brake elements, each of the brake elements having a first end pivotably mounted on the spool and a second end which is moveable radially outward with respect to the first axis relative to the spool and defines an arcuate brake surface which is urged against the brake surface with the brake element in the first position to generate the first braking force as an incident of the spool rotating at a first predetermined velocity.

7. The chalk line holder according to claim 1, wherein:

the spool comprises a) a line-carrying frame moveable relative to the housing from a first, line-retrieve position wherein a line carried on the frame is fully wound about the spool and a paid-out position and b) a line-retrieval assembly on the line-carrying frame, the line-retrieval assembly comprising a post fixed relative to the housing and a biasing element having first and second ends, the first end attached to the frame and the second end attached to the post so as to urge the frame towards the line-retrieved position.

8. The chalk line holder according to claim 7, wherein the frame has a frame wall which defines an enclosed space, and the line-retrieval assembly is disposed within the enclosed space to prevent chalk dust disposed in the housing from collecting on the biasing element.

9. The chalk line holder according to claim 8, further comprising a first connector on the housing wall and a second connector on the post capable of coupling with the first connector to prevent the rotational movement of the post relative to the housing, wherein the frame wall has an opening through which the first and second connectors are coupled.

10. The chalk line holder according to claim 9, wherein either the first or second connector comprises a post of non-circular cross-section and the other of the first or second connector comprises a recess of non-circular cross-section.

11. The chalk line holder according to claim 7, further comprising an L-shaped post on the housing about which the chalk line is disposable to prevent movement of the spool toward the first, line-retrieve position.

12. The chalk line holder according to claim 1, wherein the housing wall comprises two housing wall pieces which define a space therebetween and the housing wall has an opening therethrough, further comprising:

an elastomeric plug disposed in the opening to prevent chalk dust disposed within the space from leaking out of the housing, the plug having a resealable slit therethrough to allow chalk dust to be introduced into the space when the slit is opened.

13. A chalk line holder comprising:

a housing;

an operating mechanism on the housing comprising a spool around which a supply of line can be wound and moveable relative to the housing about a first axis and a brake assembly for the spool, the brake assembly comprising a ratchet element moveable with the spool about the first axis, a pawl moveable transversely to the first axis between a) an engaged position wherein the pawl engages the ratchet element to prevent movement of the spool in a first direction about the first axis and b) a disengaged position, a biasing element normally urging the pawl towards the engaged position, and an actuator to move the pawl towards the disengaged position against the urging of the biasing element;

a chalk line having first and second ends, the chalk line attached at the first end to the spool; and a hook assembly attached to the second end of the chalk line, the hook assembly consisting of a hook and a sheath which is disposable over the hook, the sheath having a wall which defines a receptacle and which has an opening therethrough to accept the second end of the chalk line with the second end of the chalk line attached to the hook, the sheath being moveable along the chalk line between a covered position wherein the sheath is disposed along the chalk line such that the hook is disposed within the receptacle and an uncovered position.

14. A chalk line holder comprising:

a housing; and an operating mechanism on the housing comprising a spool around which a supply of line can be wound and a brake assembly, the spool having a) a central hub with a cylindrical surface and a central axis and b) two flanges spaced axially relative to the central axis so that the flanges and cylindrical surface cooperatively define a space for a supply of chalk line, the brake assembly comprising a notch in each of the two flanges, a brake surface, an actuator formed integrally with the brake surface and mounted on the housing for movement between a) an engaged position wherein the brake surface is seated in both of the notches to prevent movement of the spool in a first rotational direction about the central axis and b) a disengaged position.

15. The chalk line holder according to claim 14, wherein the actuator comprises a T-shaped switch having a crossbar and a post, the brake surface defined by a surface of the crossbar of the T-shaped switch.

16. The chalk line holder according to claim 15, wherein the T-shaped switch is mounted on the housing about an axis parallel to and offset from the spool axis such that the post of the T-shaped switch is parallel to a tangent to the cylindrical surface with the actuator in the engaged position.

17. The chalk line holder according to claim 14 further comprising a spring for urging the actuator towards the engaged position.

18. The chalk line holder according to claim 14 wherein the actuator is pivotably mounted on the housing.

19. A chalk line holder comprising:

a housing;

an operating mechanism on the housing comprising a spool around which a supply of line can be wound and moveable relative to the housing about a first axis and a brake assembly for the spool, the brake assembly comprising a ratchet element moveable with the spool about the first axis, a pawl moveable between a) an engaged position wherein the pawl engages the ratchet element to prevent movement of the spool in a first direction about the first axis and b) a disengaged position, and an actuator to move the pawl from one of the engaged and disengaged portions towards the other of the engaged and disengaged positions a chalk line having first and second ends, the chalk line attached at the first end to the spool; and a hook assembly attached to the second end of the chalk line, the hook assembly consisting of a hook and a sheath which is disposable over the hook, the sheath having a wall which defines a receptacle and which has an opening therethrough to accept the second end of the chalk line with the second end of the chalk line attached to the hook, the sheath being moveable along the chalk line between a covered position wherein the sheath is disposed along the chalk line such that the hook is disposed within the receptacle and an uncovered position.

* * * * *